US005572811A

United States Patent [19]

Lehrman

[11] Patent Number: 5,572,811

[45] Date of Patent: Nov. 12, 1996

[54] IRONING BOARD WITH TELESCOPING STORAGE RACKS

[76] Inventor: David Lehrman, 207 Barclay Cir., Cheltenham, Pa. 19012

[21] Appl. No.: 369,836

[22] Filed: Jan. 6, 1995

[51] Int. Cl.[6] ..... D06F 81/02

[52] U.S. Cl. ..... 38/106; 38/111

[58] Field of Search ..... 38/103, 106, 107, 38/111; 211/126, 182, 105.3; 248/117.1; 219/245, 259; 108/122, 123, 131, 132

[56] References Cited

U.S. PATENT DOCUMENTS

| | | | |
|---|---|---|---|
| 75,120 | 3/1868 | Boydston | 38/106 |
| 160,208 | 2/1875 | Lake | 38/111 |
| 662,997 | 12/1900 | Wren et al. | 38/111 |
| 861,453 | 7/1907 | Funk | 38/106 |
| 970,207 | 9/1910 | Foster . | |
| 1,063,685 | 6/1913 | Hoffine | 38/111 |
| 1,162,778 | 12/1915 | Hoffine | 38/111 XR |
| 1,221,487 | 4/1917 | Trifshauser | 38/111 |
| 1,390,605 | 9/1921 | Davis | 38/106 |
| 1,589,284 | 6/1926 | Yates et al. | 38/111 |
| 1,673,583 | 6/1928 | Nystrom . | |
| 1,687,754 | 10/1928 | Faris | 38/111 |
| 1,871,813 | 8/1932 | McLain | 38/111 |
| 2,165,548 | 7/1939 | Hipp | 38/106 |
| 2,287,646 | 6/1942 | Steele | 38/142 |
| 2,333,516 | 11/1943 | Brusilowsky | 248/117.1 XR |
| 2,486,628 | 11/1949 | Baker | 38/111 |
| 2,514,813 | 7/1950 | Tiegs | 38/111 |
| 2,548,751 | 4/1951 | Till | 38/111 |
| 2,551,530 | 5/1951 | Detwiler | 38/111 |
| 2,554,446 | 5/1951 | Nestor | 38/113 |
| 2,564,627 | 8/1951 | Rauscher | 38/111 |
| 2,635,369 | 4/1953 | Baker | 38/111 |
| 2,639,522 | 5/1953 | McCann | 38/111 |
| 2,708,323 | 5/1955 | Caddel | 38/111 |
| 2,754,603 | 7/1956 | Williams | 38/106 |
| 2,880,532 | 4/1959 | Strong | 38/141 |
| 2,941,320 | 6/1960 | Caddel | 38/111 |
| 2,955,370 | 10/1960 | Tipping | 38/135 |
| 3,174,237 | 3/1965 | Detwiler | 38/106 |
| 3,268,192 | 8/1966 | Munson | 248/117.1 |
| 4,775,056 | 10/1988 | Inglis | 211/100 XR |
| 4,910,896 | 3/1990 | Ruschitzka | 38/106 |
| 5,038,502 | 8/1991 | Dooley et al. | 38/106 |
| 5,136,798 | 8/1992 | Dooley et al. | 38/106 |
| 5,142,802 | 9/1992 | Krause | 38/107 |
| 5,161,316 | 11/1992 | Saito | 38/36 |

FOREIGN PATENT DOCUMENTS

| | | | |
|---|---|---|---|
| 516231 | 9/1955 | Canada | 38/139 |
| 0328727 | 8/1989 | European Pat. Off. | 38/135 |
| 2359926 | 7/1976 | France | 38/106 |
| 2475590 | 8/1981 | France | 38/103 |
| 3077599 | 4/1991 | Japan | 38/107 |

*Primary Examiner*—Ismael Izaquirre

*Attorney, Agent, or Firm*—Seidel, Gonda, Lavorgna & Monaco, P.C.

[57] ABSTRACT

A foldable ironing board including forward and aft support legs which are foldable with respect to an ironing table. A lower rack is mounted to the support legs below the ironing table and includes two rack portions which are each pivotally connected to one of the support legs. The pivotal attachment permits each rack portion to rotate with respect to its attached support leg. The rack portions are telescopically attached to one another so as to permit displacement therebetween when the support legs scissor apart during folding. In the preferred embodiment of the invention, the telescopic interconnection between the rack portions includes three rod members extending from one rack portion which slidably engage with complimentary cylindrical tubes formed on the other rack portion. The present invention also contemplates an upper rack slidably attached to the ironing table near its heel through rails slidably disposed within rail guides located on the bottom of the ironing table. The upper rack can be stored under the ironing table when not in use and slid out when it is desired to rest an iron thereon.

21 Claims, 4 Drawing Sheets

IRONING BOARD WITH TELESCOPING STORAGE RACKS

FIELD OF THE INVENTION

The invention relates to ironing boards and, more particularly, to an improved folding ironing board with storage racks mounted thereon which do not interfere with the normal opening and closing of the ironing board.

BACKGROUND OF THE INVENTION

Folding or collapsible ironing boards are well known and extremely popular inasmuch as they occupy a relatively small amount of storage area when not in use, yet can be extended or opened to a normal, operative ironing height. Boards of this type have been in existence for many years and have been the subject of numerous modifications.

One such modification is disclosed in U.S. Pat. No. 1,589,284 wherein a rack is slidably disposed on the folding legs of the ironing board. The rack provides an area upon which to lay clothes to be ironed or to store various ironing components. A drawback to this type of rack is that, when folding of the ironing board is desired, the rack must be removed to prevent it from interfering with the folding of the board.

Another ironing board design with a rack mounted thereon is shown in U.S. Pat. No. 5,038,502 wherein the rack, useful for carrying items required during the ironing process, is hooked onto the heel of the ironing board and is capable of being folded with the board during storage. The primary deficiency with this type of ironing board configuration is that during folding, the rack does not automatically collapse with the legs of the ironing board frame but, instead, must be disconnected and swiveled out of the way of the folding legs, then clipped back on.

A need therefore exists for a foldable ironing board which includes a storage rack mounted below the main ironing table which does not interfere with the opening and retracting of the ironing board and which will automatically collapse with the ironing board when folded.

SUMMARY OF THE INVENTION

One object of the present invention is to provide a folding ironing board with a lower rack mounted thereto which does not interfere with the extension and retraction of the ironing board.

Another object of the present invention is to provide a lower rack which is pivotally mounted to the support legs of the ironing board and which has portions that telescope with respect to one another.

Yet another object of the present invention is to provide a upper rack slidably attached to the ironing board which provides a surface for placing an iron.

These and other objects are achieved through the ironing board of the present invention which includes an ironing table and skeletal support structure that has forward and aft support legs extending therefrom. The support legs are pinned to one another at a point along their respective lengths which permits the support legs to scissor with respect to one another. A lower rack is mounted to the support legs below the ironing table and includes two portions which are each pivotally connected to one of the support legs. The pivotal attachment, preferably, comprises a cylindrical tube, mounted perpendicular to the support legs, into which is rotatably disposed at least one crossbar which is, in turn, attached to the rack portion. The pivotal attachment permits each rack portion to pivot with respect to its attached support leg.

In order to permit the ironing board to fold without interference from the lower rack, the rack portions are telescopically attached to one another, which permits displacement therebetween when the support legs scissor apart during folding. In the preferred embodiment of the invention, the telescopic interconnection between the rack portions comprises a plurality of rod members, preferably three rod members, extending from one rack portion into slidable engagement with complimentary cylindrical tubes formed on the other rack portion.

The present invention also, optionally, includes an upper rack attached to the ironing table near its heel. The attachment of the upper rack to the ironing board is accomplished through rails in the upper rack slidably disposed within rail guides formed on the ironing board underside. The upper rack can be stored under the ironing table when not in use and slid out when it is desired to rest an iron thereon.

The foregoing and other objects features and advantages of the present invention will become more apparent in light of the following detailed description of the preferred embodiments thereof, as illustrated in the accompanying drawings.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENT

Figure 1:
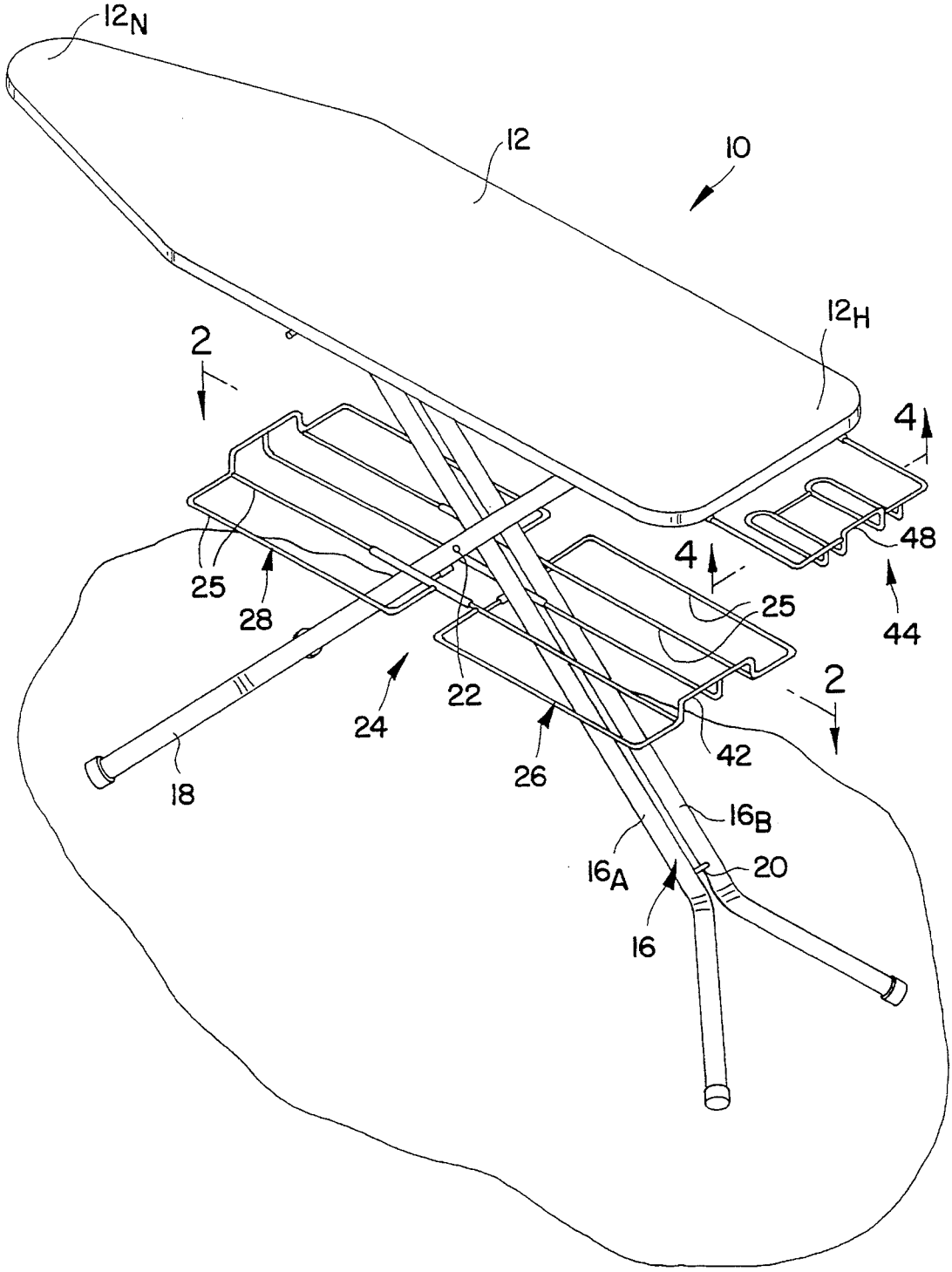
FIG. 1 is an isometric view of the ironing board with storage racks according to the present invention.

Referring now to the drawings wherein like reference numerals illustrate corresponding or similar elements throughout the several views, FIG. 1 illustrates the foldable ironing board 10 of the present invention in its open, operative position. The ironing board 10 is capable of being folded to a collapsed or retracted position (not shown) as will be discussed in more detail hereinbelow. The ironing board 10 has a normal ironing table 12 which includes a nose portion $12_N$ and a heel portion $12_H$. The ironing table 12, furthermore, has a skeletal structure 14 (FIG. 5) which provides support for the ironing table 12 during the ironing process. The configuration of the skeletal structure 14 is not critical to the invention apart from the specific aspects thereof discussed below. The skeletal structure 14 may be formed integral with the ironing table 12 or, alternately, may be separately attached thereto.

The ironing board 10 has forward and aft support legs 16, 18 which mount to and provide support for the ironing table 12 while in its raised, open position. The mounting of at least one of the forward and aft support legs 16, 18 to the underside of the ironing table 12 is, preferably, through a slidable attachment which permits the support leg to slide with respect to the ironing table 12, when the ironing board 10 is being folded. Those skilled in the field of ironing boards are well aware of the various attachment mechanisms that exist for mounting support legs to a folding ironing board and, therefore, no further discussion is needed.

Figure 2:
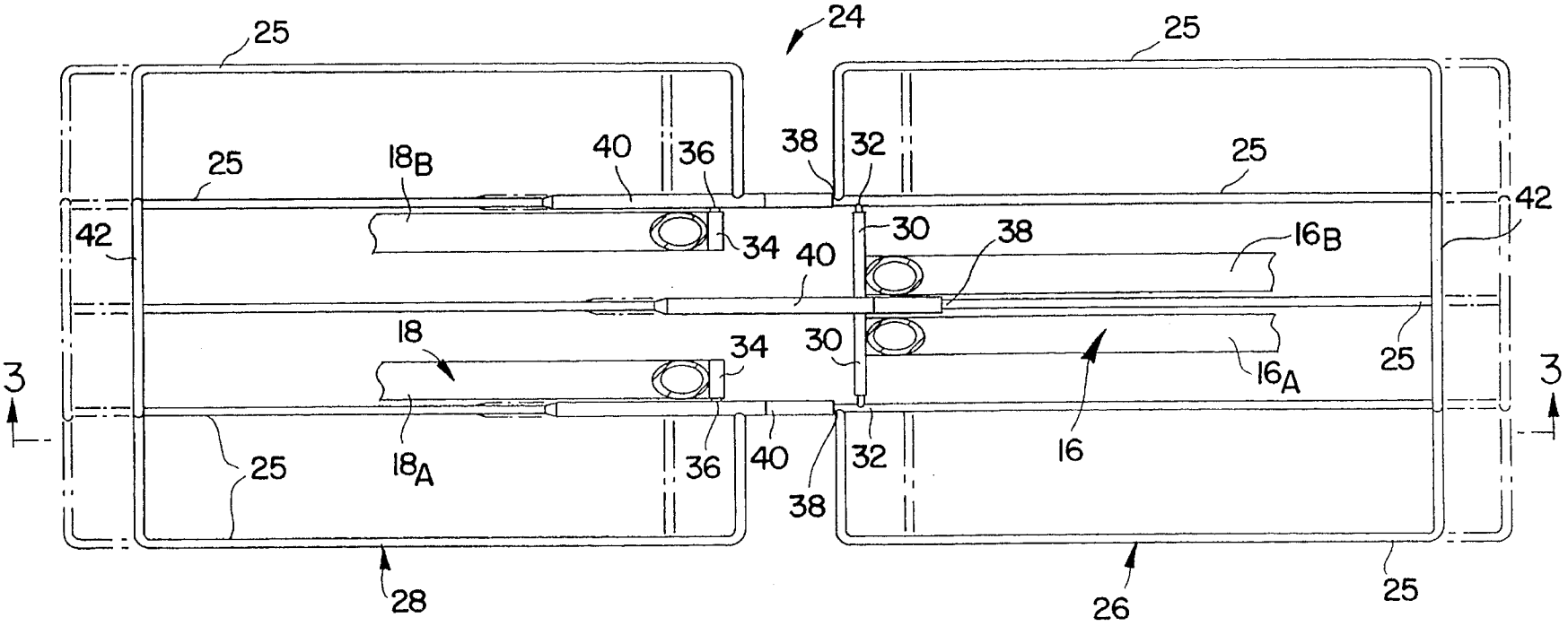
FIG. 2 is a cross-sectional view of the ironing board according to the present invention taken along lines 2—2 of FIG. 1 and illustrating the lower rack.

The forward support leg 16 connects to the skeletal structure 14 of the ironing table 12 and extends in a rearwardly direction. The aft support leg 18 connects to the skeletal structure 14 at a location aft of the forward support leg 16 attachment and extends in a forwardly direction. In the embodiment illustrated in FIG. 1, the forward support leg 16 has two spaced apart, parallel leg members $16_A$ and $16_B$, attached to one another at least at one location by a leg brace 20. The aft support leg 18, similarly, has two spaced apart, parallel leg members $18_A$ and $18_B$ which are shown in FIG. 2.

The forward support leg 16 and the aft support leg 18 are pivotally attached to one another at a prescribed location 22 along their respective lengths. The pivotal attachment can be made by any suitable means, for example, pinning or bolting of the support legs 16, 18 to one another. When the ironing board 10 is folded to either its standing (open) or collapsed (retracted) positions, the support legs 16, 18 pivot about point 22 causing the portions of the support legs 16, 18 above and below pivot point 22 to "scissor" with respect to each other. For example, when the ironing board 10 is folded from its open, operative position shown in FIG. 1 to a collapsed position, the forward and aft support legs 16, 18 pivot about point 22 causing their respective upper ends to move apart from one another. The lower ends of the support legs 16, 18 function in an identical fashion, i.e., the ends move apart during folding to a collapsed position.

The support legs 16, 18, skeletal structure 14 and ironing table 12 are each, preferably, made from metallic material, such as aluminum or steel, so as to provide a stable and strong ironing board 10 upon which to iron. Plastic material may also be utilized to make some or all of the components if a lightweight design is desired.

A lower rack 24 is shown mounted to the ironing board 10 at a position below the ironing table 12 and, more specifically, below pivot point 22. The position of the lower rack 24 on the support legs 16, 18 is designed to facilitate its use, e.g., permit access to items stored thereon, and to prevent interference with the folding of the ironing board 10. The lower rack 24 is, preferably, configured to lie along a substantially horizontal plane and includes a plurality of spaced apart rungs 25. The rungs 25 are arranged so as to avoid interfering with the folding legs as will be described below. The rungs 25 may be made from any type of material, e.g. , plastic, wood, etc., but are preferably formed from a metallic material, such as steel.

Referring now to FIG. 2, the lower rack 24 has a first rack portion 26 and a second rack portion 28, wherein each rack portion 26, 28 is, preferably, mounted to a respective supporting leg 16, 18. More particularly, the first rack portion 26 is pivotally attached to the forward support leg 16 and the second rack portion 28 is pivotally attached to the aft support leg 16. The pivotal attachment of the first rack portion 26 is provided by means of at least one cylindrical tube 30 mounted to the forward leg support 16, such as by welding or bonding. In the preferred embodiment there is one horizontally oriented, cylindrical tube 30 welded perpendicular to both forward leg members $16_A$, $16_B$. The first rack portion 26 has at least one crossbar 32 which extends through and is rotatably disposed within the cylindrical tube 30. The crossbar 32 may be separately attached to the first rack portion 26 but, more preferably, is an integral extension thereof. In an alternate embodiment, two crossbars 32 are positioned on opposite sides of the cylindrical tube 30, both being rotatably disposed within a portion of the cylindrical tube 30. Those skilled in the art would appreciate the diverse means available for pivotally mounting the first rack portion 26 to the forward support leg 16. The pivotal attachment described above permits the first rack portion 26 to rotate with respect to the forward support leg 16 when the ironing board 10 is folded.

Figure 2A:
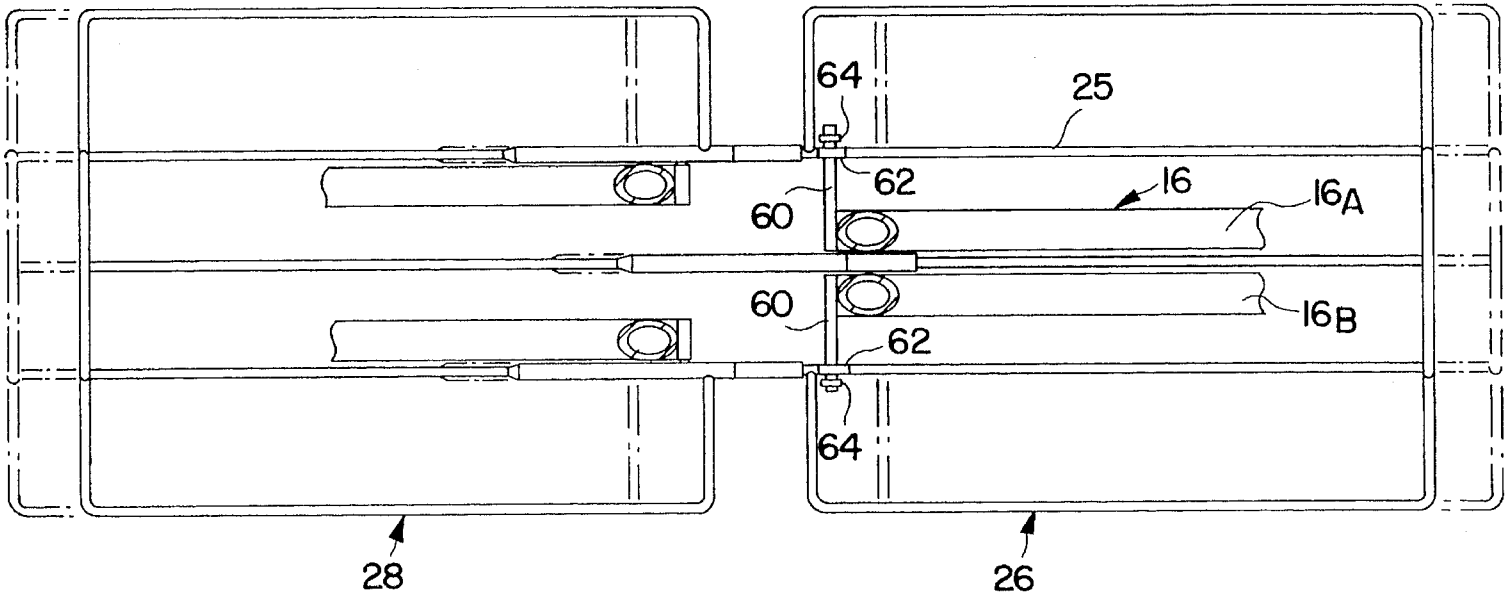
FIG. 2*a* is a cross-sectional view of an alternate embodiment of the ironing board according to the present invention illustrating the lower rack.

In an alternate configuration, shown in FIG. 2*a*, laterally projecting pins 60 are welded or otherwise attached to the forward support leg 16. The pins extend through loops 62 formed on the first rack portion 26 and have stops 64 formed thereon for preventing the loops 62 from sliding off the pins 60. The stops 64 may be nuts which engage with threads formed on the pins 60. The interfit between the pins 60 and the loops 62 permits rotation therebetween, thus, providing a pivotal attachment of the first rack portion 26 to the forward support leg 16.

The second rack portion 28 is pivotally attached to the aft support leg 18 in a manner similar to the first rack portion 26. However, instead of a single cylindrical tube, two horizontally oriented cylindrical tubes 34 are, preferably, utilized to mount the second rack portion 28 to the aft support leg 18, with one of the cylindrical tubes 34 mounting to each of the aft leg members $18_A$ , $18_B$ . Again, as with the pivotal attachment of the first rack portion 26, the cylindrical tubes 34 are mounted perpendicular to the aft leg members $18_A$, $18_B$. Crossbars 36 on the second rack portion 28 are rotatably disposed within each of the cylindrical tubes 34. The crossbars 36 may be separately attached to the second rack portion 28 or, more preferably, are integral extensions thereof.

In order to prevent the first and second rack portions 26, 28 from pivoting when the ironing board 10 is extended and in use, they are mounted to each other for support. That is, the first rack portion 26 is mounted to the second rack portion 28 so as to prevent the first rack portion 26 from rotating with respect to the forward support legs 16, and vice-versa. While it is possible to mount each rack portion 26, 28 directly to its respective support leg to inhibit rotation, doing so is relatively complex and, therefore, it is not preferable.

Each rack portion is pivotally attached to a respective support leg. Consequently, the rack portions 26, 28 will move apart from each other as the ironing board is collapsed and the support legs 16, 18 scissor apart. The racks portions 26, 28 must, therefore, be attached to each other in such a way so as to permit this relative displacement. To allow for the required displacement, the first and second rack portions 26, 28 are telescopically attached to one another so as to maintain interconnection therebetween during folding of the ironing board 10. More specifically, the first rack portion 26 has at least one telescopic member 38, which slidably mates with a complimentary telescopic member 40 on the second rack portion 28 so as to permit slidable movement therebetween.

In the preferred embodiment depicted in the figures, there are three telescopic members 38 on the first rack portion 26 which are integral extensions of the rungs 25. The second rack portion 28, accordingly, has three complimentary telescopic members 40, in the embodiment shown, which are formed on the rungs 25 of the second rack portion 28. The complimentary telescopic members 40 on the second rack portion 28 are, more specifically, hollow, cylindrical tubes in which the telescopic members 38 on the first rack portion 26 slide. The cylindrical tubes 40 are, preferably, welded to the rungs 25 of the second rack portion 28. It should be noted that, while the figures show the telescopic members 38 of the first rack portion 26 as being cylindrical rods which slide within the complimentary telescopic members 40 of the second rack portion 28, an opposite configuration is well within the purview of this invention, e.g., cylindrical rods on the second rack portion 28 and cylindrical tubes on the first rack portion 26. The shape of the telescopic members 38 and complimentary telescopic members 40 need not be cylindrical so long as the combination permits translational motion between the rack portions 26, 28. For example, dovetail-type slide arrangements may be substituted in place of the telescopic members and complimentary telescopic members. Those skilled in the art will readily appreciate the diverse sliding arrangements that may be incorporated into the present invention to provide the displacement required.

Through the telescopic relationship between the first rack portion 26 and the second rack portion 28, it is possible for the forward and aft support legs 16, 18 to separate and fold up against the ironing table 12 without the lower rack 24 interfering. Furthermore, the mounting of the first and second rack portions 26, 28, directly to the forward and aft support legs 16, 18, results in the automatic folding of the rack 24 with the folding of the support legs 16, 18. The mounting of the first and second rack portions 26, 28 is also designed to place the rack portions 26, 28 on substantially the same plane when the ironing board is open. In the preferred embodiment illustrated, the rack portions 26, 28 lie along a substantially horizontal plane.

Figure 3:
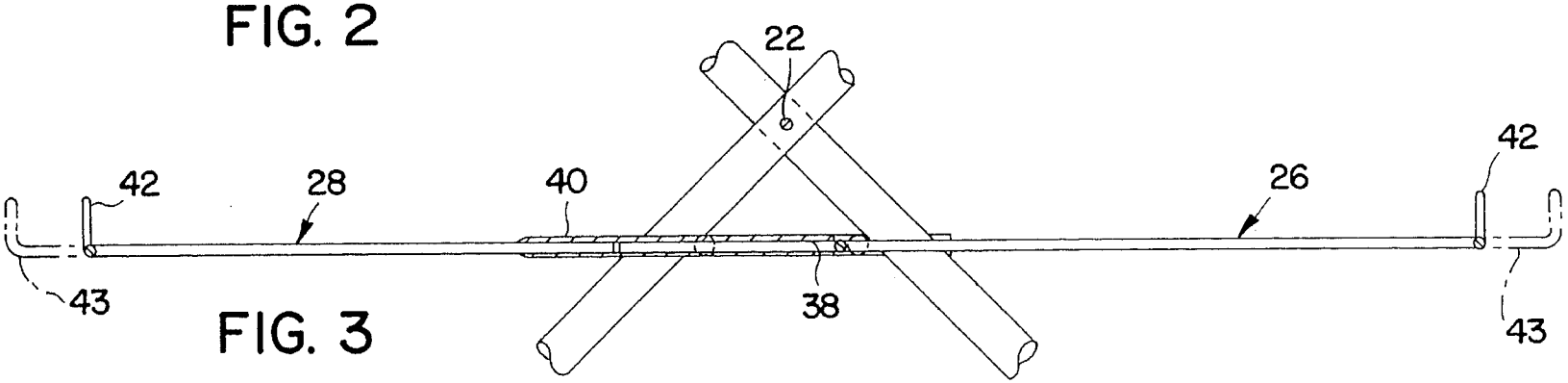
FIG. 3 is a cross-sectional view of the ironing board according to the present invention taken along lines 3—3 of FIG. 2 with a partial exploded view of the telescoping attachment.
Figure 3A:
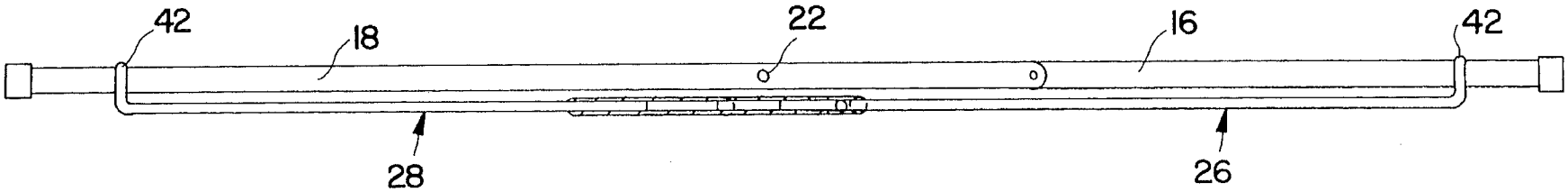
FIG. 3*a* is a partial cross-sectional view of the ironing board according to the present invention with the support legs in the folded or retracted position.

Referring to FIG. 3, the lower rack 24 has joggled rugs 42 which project away from the horizontal plane that lower rack 24 lies along when the ironing board is open. The joggled rungs 42 are designed to allow the ironing board 10 to be collapsed from the open position without the rack 24 interfering with the folding of the support legs 16, 18, Hence, the support legs 16, 18 can be located relatively close to the skeletal structure 14 of the ironing table 12 when the ironing board 10 is fully retracted, as shown in FIG. 3*a* (the ironing table 12 is not shown for clarity). The joggled rungs 42, furthermore, add strength to the rack portions 26, 28 by providing structural continuity between the rungs 25. If additional strength is not required, the joggled rungs 42 need not be incorporated. It is important, however, that the rungs 25 be arranged so as to avoid interfering with the folding support legs 16, 18. Accordingly, if joggled rungs 42 are not incorporated, gaps may then be needed between the rungs 25 so as to permit the forward and aft support legs 16, 18 to pass therethrough when the ironing board 10 is folded. FIG. 3 also shows, by means of phantom lines 43, the extended or telescoped position of the rack portions 26, 28 when the ironing board 10 is folded into its collapsed position.

An additional benefit provided by the telescoping arrangement of the present invention is increased structural support of the rack 24 when the ironing board 10 is in its open position. More specifically, when the ironing board 10 is open, the telescopic members 38 and the complimentary telescopic members 40 overlap to a significant degree, as shown in FIG. 3, providing increased stiffness in the vicinity of the rack 24 attachment to the support legs 16, 18 for withstanding the applied loads. Hence, the rack 24 provides a relatively stable structure on which to locate articles.

Referring back to FIG. 1, an upper rack 44 is shown mounted below the ironing board heel $12_H$. The upper rack 44 comprises a series of rungs 46, preferably metal, which are spaced apart from one another. The upper rack is designed to hold items which are used during an ironing process, such as an iron. The spacing of the rungs 46 permits air to pass therethrough and assist in the cooling of an iron after an ironing process is complete. In an alternate configuration, the rungs 46 may, instead, be replaced by a continuous surface for holding small items, such as needles and buttons.

Figure 4:
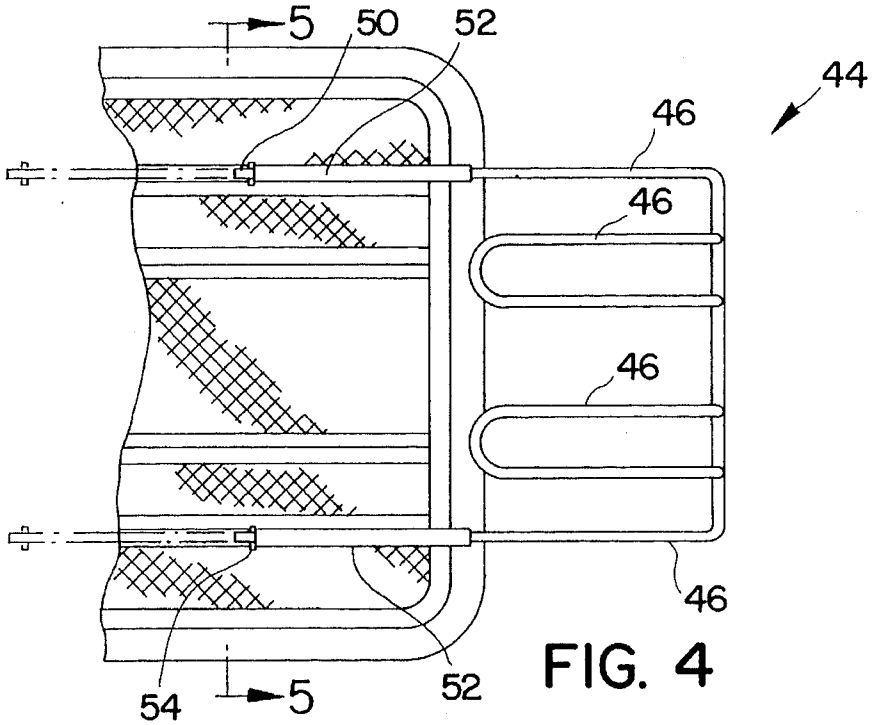
FIG. 4 is a partial bottom view of the ironing board according to the present invention taken along lines 4—4 of FIG. 1 and illustrating the upper rack.
Figure 5:
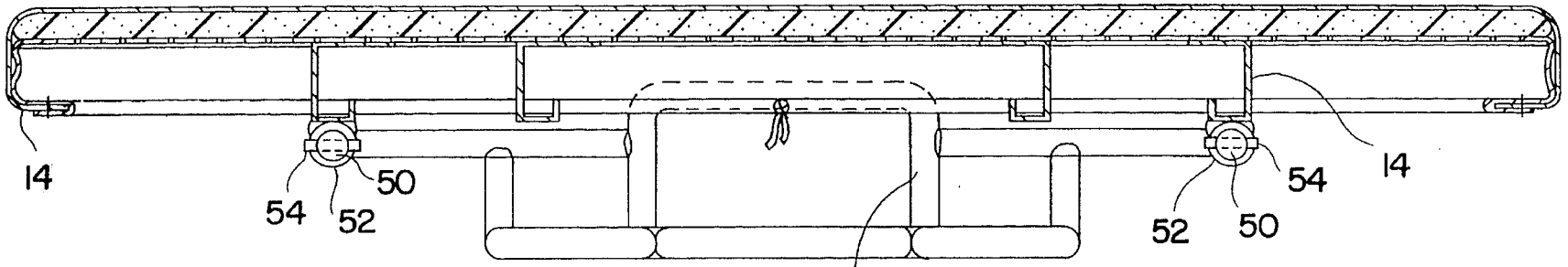
FIG. 5 is a cross-sectional view of the upper rack according to the present invention taken along lines 5—5 of FIG. 4.

The upper rack 44 is slidably mounted to the skeletal structure 14, as shown in FIGS. 4 and 5. The slidable attachment permits a substantial portion of the upper rack 44 to be slid under the ironing table 12 when not in use, e.g., stored. A handle 48 may be formed thereon which facilitates the sliding of the upper rack 44. In the preferred embodiment, the handle 48 is an extension of the rungs 46 and does not slide under the ironing table 12 when the upper rack 44 is stored so as to permit a user to readily grasp the handle when desired. If a handle 48 is not incorporated, the entire upper rack 44 can be slid under the ironing table, if desired.

Specifically, the upper rack 44 has rails 50 which extend therefrom and are designed to slide within rail guides 52 formed on the skeletal structure 14 and which provide channels for supporting and directing the rails 50. In the preferred embodiment, the rails 50 are cylindrical in shape and are extensions of the rungs 46. The rail guides 52 have a cylindrical surface which mates with the cylindrical surface of the rails 50. The rail guides 52 are shorter in length then the rails 50 such that the rails 50 extend past the rail guides 52 as shown in FIG. 4. Retention members 54 are attached to the ends of the rails 50, which are located on the opposite side of the rail guides 52 from the upper rack 44. The retention members 54 function to limit the extension of the upper rack 44, from under the ironing table 12. In the preferred embodiment, the retention members 54 are pins press-fit within holes in the rails 50 and have a length sufficiently larger than the opening in the rail guides 52 so as to prevent the passage of the rails 50 therethrough. It is also preferable to provide sufficient clearance between the rails 50 and the ironing table 12 to permit a ironing board cover (not shown) to be placed on the ironing table 12. Other types of retention mechanisms can be substituted without departing from the scope of the invention.

Phantom lines 56 are shown in FIG. 4 to illustrate the position of the rails 50 in the fully retracted position of the upper rack 44.

In order to provide sufficient structural support for the upper rack 44, it is preferable that there are two rails 50 extending from laterally opposed sides of the upper rack 44, each rail 50 slidably engaging with a corresponding rail guide 52. The rails 50 and rail guides 52 are, preferably, made from a metallic material, such as steel or aluminum. Plastic material may, instead, be substituted if a lightweight design is desired provided that the plastic material is capable of withstanding the normal operating temperatures of an iron which may be placed thereon.

As described in detail above with respect to the preferred embodiment, the ironing board 10 has the lower rack 24 attached to the support legs 16, 18 at a position below the ironing table 12 when in its operative position, shown in FIG. 1. When it is desired to fold the ironing board 10 for storage, the support legs 16, 18 are caused to scissor about pivot point 22. The first and second rack portions 26, 28, accordingly, telescope away from one another, i.e., the telescoping member 38 of one rack portion sliding within the complimentary telescoping member 40 of the other rack portion, while, simultaneously, each rack portion 26, 28 pivots within its respective cylindrical tube 30, 34. As shown in FIG. 3*a*, when the ironing board 10 is fully retracted, the joggle rung 42 of the first rack portion 26 will be positioned between the forward support leg 16 and the skeletal structure 14 of the ironing table 12 with the remainder of the first rack portion 26 positioned outboard of the forward support leg 16. Similarly, the joggle rung 42 of the second rack portion 28 will be positioned between the aft support leg 18 and the skeletal structure 14 of the ironing table 12 with the remainder of the second rack portion 28 positioned outboard of the aft support leg 18. The upper rack 44 will also be positioned between the aft support legs 18 and the skeletal structure 14 and, more particularly, between the joggle rung 42 of the first rack portion 26 and the skeletal structure 14.

It should be noted that in the embodiment illustrated and described above, the first and second rack portions 26, 28 are mounted to the lower side of their respective support legs 16, 18. Alternately, one or both of the rack portions 26, 28 could be mounted to the upper or side surfaces of the support legs 16, 18, which would result in the rack portions 26, 28 being positioned entirely between, or in line with, the support legs 16, 18 and the skeletal structure 14 of the ironing table 12 when folded. Those skilled in the art should readily understand and appreciate the diverse positions of the rack portions 26, 28 that are possible by varying the attachment of the lower rack 24.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

What is claimed:

1. A collapsible ironing board comprising:

an ironing table with a nose portion and a heel portion;

a forward support leg connected to said ironing table structure and extending in a rearward direction;

an aft support leg connected to said ironing table aft of said forward support leg and extending in a forward direction;

said forward and aft support legs being attached to one another at a prescribed location along their respective lengths;

said ironing board furthermore being foldable between an open position and a retracted position wherein said forward and aft support legs are folded against said ironing table in the retracted position;

a first rack portion pivotally mounted to said forward support leg and having at least one telescopic member;

a second rack portion pivotally mounted to said aft support leg and having at least one complimentary telescopic member which mates with said telescopic member on said first rack portion; and wherein said telescopic member and complimentary telescopic member are telescopically engaged with one another such that the rack portions are restrained into motion substantially in one plane.

2. A collapsible ironing board according to claim 1 wherein a portion of said first rack portion is positioned between said forward support leg and said ironing table in the retracted position, and wherein a portion of said second rack portion is positioned between said aft support leg and said ironing table in the retracted position.

3. A collapsible ironing board according to claim 2 wherein said first and second rack portions include a series of spaced rungs.

4. A collapsible ironing board according to claim 3 wherein said first rack portion includes a joggled rung which is positioned to lie between said ironing table and said forward support leg when said ironing board is in its retracted position.

5. A collapsible ironing board according to claim 3 wherein said forward and aft support legs each pass through a space between respective pairs of adjacent rungs.

6. A collapsible ironing board according to claim 1 wherein there are three telescopic members slidably engaged with three complimentary telescopic members.

7. A collapsible ironing board according to claim 1 further including an upper rack slidably mounted to said ironing table below the heel, said upper rack being slidable between a stored position and an extended position.

8. A collapsible ironing board according to claim 1 wherein the pivotal mounting of the first rack portion to the forward support leg being provided by at least one cylindrical pin extending laterally from the rack portion, the cylindrical pin being rotatably disposed within a cylindrical tube mounted on the forward support leg.

9. A collapsible ironing board according to claim 1 wherein the pivotal mounting of the second rack portion to the aft support leg being provided by at least one cylindrical pin extending laterally from the rack portion, the cylindrical pin being rotatably disposed within a cylindrical tube mounted on the aft support leg.

10. A collapsible ironing board having an ironing table with a nose portion, a heel portion, and a skeletal support structure, the ironing board adapted to assume either a standing position or a collapsed position, wherein the ironing board comprises:

a forward support leg connected to the ironing table and extending in a rearward direction;

an aft support leg connected to the ironing table aft of said forward support leg and extending in a forward direction;

said forward and aft support legs being attached to one another at a prescribed location along their respective lengths, and being folded against the ironing table when in the collapsed position;

a first rack portion pivotally mounted to said forward support leg and having a telescopic member formed thereon;

a second rack portion pivotally mounted to said aft support leg and having a complimentary telescopic member formed thereon which mates with said telescopic member;

wherein said telescopic member and said complimentary telescopic member are telescopically engaged with one another such that the rack portions are restrained into motion substantially in one plane; and an upper rack slidably mounted to the skeletal support structure of the ironing table below the heel, said upper rack being slidable between a stored position and an extended position and having a handle formed thereon.

11. A collapsible ironing board comprising:

an ironing table having a heel portion;

a forward support leg connected to said ironing table and extending in a rearward direction;

an aft support leg connected to said ironing table aft of said forward support leg and extending in a forward direction;

said forward and aft support legs being attached to one another at a prescribed location along their respective lengths;

said ironing board being foldable between an open position and a retracted position wherein said forward and aft support legs are folded against said ironing table in said retracted position;

a first rack portion pivotally mounted to said forward support leg, the pivotal mounting of the first rack portion to the forward support leg being provided by at least one cylindrical pin rotatably disposed within a cylindrical tube, the cylindrical pin and tube being attached so as to be perpendicular to the forward support leg;

a second rack portion pivotally mounted to said aft support leg, the pivotal mounting of the second rack portion to the aft support leg being provided by at least one cylindrical pin rotatably disposed within a cylindrical tube, the cylindrical pin and tube being attached so as to be perpendicular to the aft support leg; and means for attaching said first rack portion to said second rack portion and for permitting relative axial motion therebetween while inhibiting lateral motion therebetween when the forward and aft support legs are folded between said open position and said retracted position.

12. A collapsible ironing board according to claim 9 further including an upper rack slidably mounted to said ironing table below the heel, said upper rack being slidable between a stored position and an extended position.

13. A collapsible ironing board according to claim 9 wherein said means for attaching comprises at least one hollow element attached to one of said rack portions and at least one mating element on the other of said rack portions and slidably disposed within said hollow element.

14. A collapsible ironing board according to claim 13 wherein said at least one hollow element comprises three cylindrical tubes mounted on said second rack portion, and wherein said at least one mating element comprises three cylindrical rods formed on said first rack portion.

15. A collapsible ironing board according to claim 11 wherein the cylindrical tubes are fixedly mounted on their respective support legs and the cylindrical pins are fixedly attached to their respective rack portions.

16. A collapsible ironing board having an ironing table and being foldable between an open position and a retracted position, wherein the ironing board comprises:

a forward support leg connected to the ironing table and extending in a rearward direction;

an aft support leg connected to the ironing table aft of said forward support leg and extending in a forward direction;

said forward and aft support legs being folded against the ironing table when in the retracted position; and a lower rack mounted to said forward and aft support legs and being automatically pivotable with respect thereto when the ironing board is folded between the open and retracted positions, said lower rack having two portions, one of the rack portions having a cylindrical extension member and the other rack portion having a tubular mating member, the cylindrical extension member being slidably disposed within the tubular mating member so as to permit the rack portions to telescope with respect to one another during folding of the ironing board, and wherein the pivoting of the lower rack is provided by a plurality of cylindrical pins rotatably disposed within cylindrical tubes, the cylindrical pins and tubes connecting the lower rack to the forward and aft support legs.

17. A collapsible ironing board having an ironing table and being foldable between an open position and a retracted position, wherein the ironing board comprises:

a forward support leg connected to the ironing table and extending in a rearward direction;

an aft support leg connected to the ironing table aft of said forward support leg and extending in a forward direction;

said forward and aft support legs being folded against the ironing table when in the retracted position; and a lower rack mounted to said forward and aft support legs and having a plurality of rungs, the rack being automatically pivotable with respect to the support legs when the ironing board is folded between the open and retracted positions, said lower rack having two portions which are attached to one another by means of a plurality of extension members telescopically disposed within complementary mating members, the telescopic attachment of the rack portions forming a continuous, non-hinged connection between the rack portions, and wherein the support legs extend between the rungs of the lower rack.

18. A collapsible ironing board according to claim 17 wherein the rungs of the lower rack define at least one plane and wherein the support legs extend through the plane.

19. A collapsible ironing board comprising:

an ironing table with a nose portion and a heel portion;

a forward support leg connected to said ironing table structure and extending in a rearward direction;

an aft support leg connected to said ironing table aft of said forward support leg and extending in a forward direction;

said forward and aft support legs being attached to one another at a prescribed location along their respective lengths;

said ironing board furthermore being foldable between an open position and a retracted position wherein said forward and aft support legs are folded against said ironing table in the retracted position;

a first rack portion pivotally mounted to said forward support leg and having at least one telescopic member;

a second rack portion pivotally mounted to said aft support leg and having at least one complimentary telescopic member which mates with said telescopic member on said first rack portion; and wherein said telescopic member and complimentary telescopic member are telescopically engaged with one another such that the telescopic members are restrained into motion substantially in one plane.

20. A collapsible ironing board comprising:

an ironing table with a nose portion and a heel portion;

a forward support leg connected to said ironing table structure and extending in a rearward direction;

an aft support leg connected to said ironing table aft of said forward support leg and extending in a forward direction;

said forward and aft support legs being attached to one another at a prescribed location along their respective lengths;

said ironing board furthermore being foldable between an open position and a retracted position wherein said forward and aft support legs are folded against said ironing table in the retracted position;

a first rack portion pivotally mounted to said forward support leg and having at least one telescopic member;

a second rack portion pivotally mounted to said aft support leg and having at least one complimentary telescopic member which mates with said telescopic member on said first rack portion; and wherein one of the telescopic members is tubular with an open end and the other telescopic member is adapted to slide into the open end of the tubular telescopic member so as to permit the rack portions to telescope with respect to one another when the ironing board is folded.

21. A collapsible ironing board according to claim 20 further comprising an upper rack slidably mounted to the ironing table below the heel, the upper rack being slidable between a stored position and an extended position and having a handle formed thereon.

* * * * *